US009097207B2

(12) United States Patent
Takahashi et al.

(10) Patent No.: US 9,097,207 B2
(45) Date of Patent: Aug. 4, 2015

(54) POWER RECOVERY SYSTEM

(75) Inventors: Kazuo Takahashi, Kobe (JP); Ryota Kokenawa, Kobe (JP); Norio Oiwa, Nagoya (JP); Akira Ishikawa, Nagoya (JP)

(73) Assignees: Kobe Steel, Ltd., Kobe-shi, Hyogo (JP); Chubu Electric Power Company, Incorporated, Nagoya-shi, Aichi (JP)

( * ) Notice: Subject to any disclaimer, the term of this patent is extended or adjusted under 35 U.S.C. 154(b) by 288 days.

(21) Appl. No.: 13/702,501

(22) PCT Filed: May 27, 2011

(86) PCT No.: PCT/JP2011/002971

§ 371 (c)(1), (2), (4) Date: Dec. 6, 2012

(87) PCT Pub. No.: WO2011/155145

PCT Pub. Date: Dec. 15, 2011

(65) Prior Publication Data

US 2013/0091839 A1 Apr. 18, 2013

(30) Foreign Application Priority Data

Jun. 9, 2010 (JP) ..... 2010-131649

(51) Int. Cl.
*F01B 29/10* (2006.01)
*F02G 1/055* (2006.01)

(52) U.S. Cl.
CPC ..... *F02G 1/055* (2013.01); *F02G 2256/00* (2013.01)

(58) Field of Classification Search
CPC ..... F02G 1/055; F02G 2256/00
USPC ..... 60/517–526; 62/6
See application file for complete search history.

(56) References Cited

U.S. PATENT DOCUMENTS 5,345,787 A * 9/1994 Piltingsrud ..... 62/55.5
5,642,618 A * 7/1997 Penswick ..... 60/520

(Continued)

FOREIGN PATENT DOCUMENTS

| | | |
|---|---|---|
| JP | 53-014258 | 2/1978 |
| JP | 11-022550 A | 1/1999 |
| JP | 2008-157144 A | 7/2008 |
| JP | 2009-144538 A | 7/2009 |

OTHER PUBLICATIONS

International Search Report issued from the International Bureau in the corresponding International Application No. PCT/JP2011/002971, mailed Aug. 16, 2011, 2 pages.

(Continued)

*Primary Examiner* — Hoang Nguyen
(74) *Attorney, Agent, or Firm* — Studebaker & Brackett PC

(57) ABSTRACT

The power recovery system includes: a Stirling engine; and a vaporization device that stores a liquid therein in such a manner that the liquid is kept in contact with an upper portion of a cylinder and vaporizes the liquid by supplying the cold heat of the liquid to the upper portion of the cylinder. The vaporization device includes a liquid container which stores the liquid therein in such a manner that the liquid is kept in contact with the upper portion of the cylinder, and an outer container embracing the liquid container and defining a space portion around the liquid container. The space portion communicates with the liquid container and an exhaust vent. Gas vaporized in the liquid container passes between the liquid container and an outer wall surface of a heat insulating material during passage thereof from the liquid container to the exhaust vent through the space portion.

8 Claims, 4 Drawing Sheets

(56) References Cited

U.S. PATENT DOCUMENTS

| | | | | |
|---|---|---|---|---|
| 6,345,666 | B1 * | 2/2002 | Conrad | 165/154 |
| 6,568,169 | B2 * | 5/2003 | Conde et al. | 60/39.6 |
| 2008/0072607 | A1 * | 3/2008 | Haberbusch et al. | 62/6 |
| 2010/0000232 | A1 * | 1/2010 | Valentian | 62/6 |
| 2013/0081390 | A1 * | 4/2013 | Takahashi et al. | 60/531 |

OTHER PUBLICATIONS

International Search Report issued from the International Bureau in the corresponding International Application No. PCT/JP2011/002971, mailed Jan. 24, 2013, 6 pages.

* cited by examiner

POWER RECOVERY SYSTEM

TECHNICAL FIELD

The present invention relates to a power recovery system including a Stirling engine and a vaporization device for vaporizing a liquid.

BACKGROUND ART

Conventionally, there exists a power recovery system which includes a Stirling engine and a vaporization device (see Patent Document 1 for example).

This power recovery system is constructed by combining the Stirling engine and the vaporization device and is designed for power recovery accompanying a liquid vaporization process.

The Stirling engine has a hot heat exchanging portion and a cold heat exchanging portion. The Stirling engine generates power by supply of hot heat to the hot heat exchanging portion and supply of cold heat to the cold heat exchanging portion.

For example, such a Stirling engine has a cylinder containing a piston. This Stirling engine generates power by actuating the piston by supply of cold heat to one end portion (cold heat exchanging portion) of the cylinder and supply of hot heat to the other end portion (hot heat exchanging portion) of the cylinder.

The vaporization device stores a low-temperature liquid such as LNG therein and vaporizes the liquid by depriving the liquid of its cold heat (latent heat), i.e., by warming the liquid.

Specifically, the vaporization device has a liquid storage portion which stores the liquid therein in such a manner that the liquid is kept in contact with one end portion of the cylinder. By supplying the cold heat (latent heat) of the liquid to the cylinder, the Stirling engine generates power, which is then recovered. In the process of the power recovery, on the other hand, the vaporization device deprives the liquid of its cold heat to vaporize the liquid into gas, which is then recovered.

With such a power recovery system, when heat from outside (hereinafter will be referred to as external heat) is transferred to the liquid storage portion, the amount of cold heat of the liquid in the liquid storage portion to be supplied to the Stirling engine is reduced by the amount of cold heat deprived of by the external heat. This means a reduction in the amount of cold heat to be used for power generation, which leads to a decrease in the power recovery rate of the system. Therefore, the transfer of the external heat to the liquid storage portion is not preferable.

In view of this, a method is conceivable which provides heat insulation for the liquid storage portion by provision of a heat insulating material, such as urethane, around the liquid storage portion. With this method, it is possible to prevent the loss of cold heat of the liquid by reducing the amount of heat to be transferred from outside to the liquid storage portion.

The heat insulating method described above can be expected to bring about a heat insulating effect to a certain degree. However, when the temperature of the heat insulating material is raised by the external heat, the heat insulating effect by the heat insulating material is lowered. For this reason, there is a problem that the power recovery rate decreases with lapse of time.

Patent Document 1: Japanese Patent Application Laid-open No. H11-22550

SUMMARY OF THE INVENTION

An object of the present invention is to provide a power recovery system which is capable of stabilizing the power recovery rate thereof.

In order to accomplish the foregoing object, the present invention provides a power recovery system including: a Stirling engine having a hot heat exchanging portion and a cold heat exchanging portion and generating power by supply of hot heat to the hot heat exchanging portion and supply of cold heat to the cold heat exchanging portion; and a vaporization device including a liquid storage portion which stores therein a liquid having cold heat in such a manner that the liquid is kept in contact with the cold heat exchanging portion, an outer member which embraces the liquid storage portion and defines a peripheral space portion around the liquid storage portion, and an exhaust portion which is located at a position away from the liquid storage portion and exhausts gas vaporized in the liquid storage portion from the outer member, the vaporization device being configured to vaporize the liquid by supplying the cold heat of the liquid to the cold heat exchanging portion, wherein the peripheral space portion communicates with the liquid storage portion and the exhaust portion to allow the gas vaporized in the liquid storage portion to pass between the liquid storage portion and an outer wall surface of the outer member during passage thereof from the liquid storage portion to the exhaust portion.

According to the present invention, it is possible to provide a power recovery system which is capable of stabilizing the power recovery rate thereof.

BEST MODE FOR CARRYING OUT THE INVENTION

Hereinafter, embodiments of the present invention will be described with reference to the attached drawings. It should be noted that the following embodiments are only specific illustrations of the present invention and are not intended to limit the technical scope of the present invention.

First Embodiment

Figure 1:
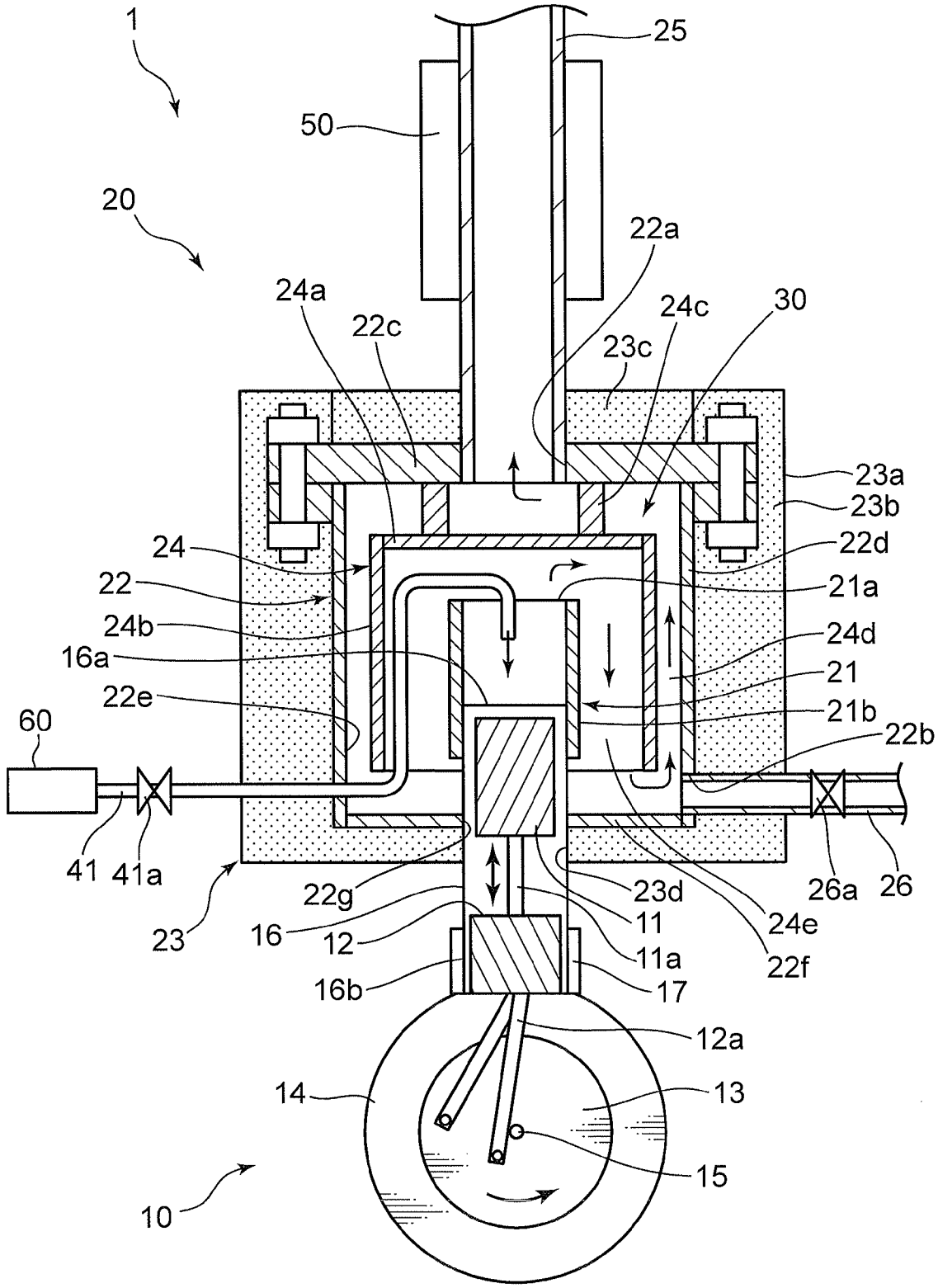
FIG. 1 is a sectional view illustrating a power recovery system according to a first embodiment of the present invention.

A power recovery system 1 illustrated in FIG. 1 performs power recovery accompanying a liquid vaporization process. Specifically, the power recovery system 1 includes a Stirling engine 10 and a vaporization device 20 for vaporizing a liquid.

The Stirling engine 10 is an engine capable of generating power by utilizing a heat difference (temperature difference).

Specifically, the Stirling engine 10 includes a displacer piston 11, a power piston 12, a crank mechanism 13, a fly wheel 14, a drive shaft 15, a cylinder 16, and a heater 17.

The displacer piston 11 and the power piston 12, together with high-pressure helium gas, are accommodated in a hermetical tubular cylinder 16. These pistons 11 and 12 are vertically aligned in the cylinder 16 for vertical movement in the cylinder 16.

The displacer piston 11 has an outer diameter that is set smaller than that of the power piston 12. Therefore, the helium gas in the cylinder 16 moves within the cylinder 16 by passing between the displacer piston 11 and the cylinder 16.

The piston 11 has a piston rod 11*a*. Likewise, the piston 12 has a piston rod 12*a*. The piston rods 11*a* and 12*a* are linked to different portions of the crank mechanism 13. The piston rod 11*a* of the displacer piston 11 extends through the power piston 12.

The crank mechanism 13 is configured to convert the vertical motion of the two pistons 11 and 12 to a rotary motion. The crank mechanism 13 is centrally provided with a drive shaft 15.

The fly wheel 14 is mounted on the drive shaft 15. The fly wheel 14 is provided for stabilizing the rotation of the drive shaft 15 by utilizing inertia.

The drive shaft 15 rotates by conversion of the vertical motion of the pistons 11 and 12 to the rotary motion by the crank mechanism 13. The drive shaft 15 is connected to a non-illustrated electric generator which generates electric power by rotation of the drive shaft 15.

The cylinder 16 has an upper portion 16*a* which functions as a cooling portion to be supplied with cold heat. The cylinder 16 has a lower portion 16*b* which functions as a heating portion to be supplied with hot heat. That is, the upper portion 16*a* of the cylinder 16 is corresponding to the "cold heat exchanging portion" defined by the present invention, while the lower portion 16*b* of the cylinder 16 is corresponding to the "hot heat exchanging portion" defined by the present invention.

In the present embodiment, the upper portion 16*a* of the cylinder 16 is in contact with a low-temperature liquid stored in a liquid container 21 of the vaporization device 20 to be described later. Thus, the cold heat (latent heat) of the liquid in the liquid container 21 is supplied to the upper portion 16*a* of the cylinder 16.

A heater 17 is disposed adjacent to the lower portion 16*b* of the cylinder 16 so as to surround the lower portion 16*b* of the cylinder 16. Hot heat generated by the heater 17 is supplied to the lower portion 16*b* of the cylinder 16.

When the upper portion 16*a* of cylinder 16 is cooled and the lower portion 16*b* of the cylinder 16 is heated, respectively, the pressure of the helium gas in the cylinder 16 fluctuates. This causes the two pistons 11 and 12 to move vertically, thus rotating the drive shaft 15 by means of the crank mechanism 13. At that time, the vertical motion of the pistons 11 and 12 is maintained by the inertia of the fly wheel 14, so that the drive shaft 15 keeps on rotating. As a result, power is recovered in the form of electric power.

The vaporization device 20 stores a low-temperature liquid (e.g., LNG: liquefied natural gas) therein and is configured to vaporize the liquid by supplying the cold heat of the liquid to the upper portion 16*a* of the cylinder 16 of the Stirling engine 10. The vaporization device 20 is designed to be capable of vaporizing the liquid continuously.

Specifically, the vaporization device 20 includes a liquid container 21, an outer container 22, a heat insulating material 23, a guide portion 24, a liquid supply device 60, and an air-heated vaporizer 50. The liquid container 21 is corresponding to the "liquid storage portion" defined by the present invention. The outer container 22 and the heat insulating material 23 construct the "outer member" defined by the present invention.

The liquid container 21 has a shape such as to be capable of storing the liquid therein at a position above the upper portion 16*a* in such a manner that the liquid is kept in contact with the upper portion 16*a* of the cylinder 16. In the present embodiment, the liquid container 21 is in a tubular form with an open top. Specifically, the liquid container 21 has an upper portion forming an opening 21*a* for vaporized gas to pass therethrough.

The outer container 22 is disposed so as to embrace the liquid container 21. Specifically, the outer container 22 includes a side wall portion 22*d* surrounding the lateral side surface of the liquid container 21 over the entire circumference thereof, a top wall portion 22*c* positioned so as to close an opening defined by the upper part of the side wall portion 22*d*, and a bottom wall portion 22*f* positioned so as to close an opening defined by the lower part of the side wall portion 22*d*.

The heat insulating material 23 is positioned so as to further embrace the outer container 22. The heat insulating material 23 includes a first heat insulating portion 23*b* covering the side wall portion 22*d* and bottom wall portion 22*f* of the outer container 22 from outside, and a second heat insulating portion 23*c* covering the top wall portion 22*c* of the outer container 22 from above. The first heat insulating portion 23*b* has a tubular side portion covering the side wall portion 22*d* and a lower portion positioned so as to close a lower opening defined by the side portion. The second heat insulating portion 23*c* is positioned so as to close an upper opening defined by the first heat insulating portion 23*b*. The heat insulating material 23 (the first heat insulating portion 23*b* and the second heat insulating portion 23*c*) has an outer wall surface 23*a* forming a portion exposed to the atmosphere and the like. The heat insulating material 23 is formed from urethane for example.

In the present embodiment, the outer container 22 (the side wall portion 22*d*, top wall portion 22*c* and bottom wall portion 22*f*) has an inner wall surface 22*e* which is spaced apart from the liquid container 21 to define a space portion 30 between the liquid container 21 and the outer container 22. The space portion 30 is corresponding to the "first space portion (peripheral space portion)" defined by the present invention.

The space portion 30 is in communication with both the opening 21*a* of the liquid container 21 and an exhaust vent 22*a* of the outer container 22 to be described later. Therefore, gas vaporized in the liquid container 21 is allowed to pass through the space portion 30 and reach the exhaust vent 22*a* from the liquid container 21. Specifically, the gas flows into the space portion 30 and is then exhausted from the exhaust vent 22*a*.

The space portion 30 is shaped so as to surround the liquid container 21 and intervenes between the liquid container 21 and the outer wall surface 23*a* of the heat insulating material 23. Therefore, the gas vaporized in the liquid container 21 passes between the liquid container 21 and the outer wall surface 23*a* of the heat insulating material 23 during the passage thereof up to the exhaust vent 22*a* through the space portion 30.

In the present embodiment, the gas vaporized in the liquid container 21 thus flows in the space portion 30 to give rise to a state in which a heat insulating barrier (gas shield layer) comprising the flowing gas (gas flow) is provided between the liquid container 21 and the outer wall surface 23*a* of the heat insulating material 23. The heat insulating barrier absorbs infiltration heat from the outer wall surface 23*a* of the heat insulating material 23. The temperature of the gas vaporized by losing its cold heat is substantially equal to that of the liquid before vaporization.

The top wall portion 22*c* of the outer container 22 is provided with the exhaust vent 22*a* for exhausting the gas present inside the outer container 22, i.e., the gas present in the space portion 30. The exhaust vent 22*a* is located above and at a position away from the opening 21*a* of the liquid container 21. The exhaust vent 22*a* thus located so as to open to an upper part of the space portion 30 allows the gas in the space portion 30 that has ascended due to a temperature rise thereof to be exhausted efficiently. An exhaust tube 25 is inserted into the exhaust vent 22*a* so as to be joined thereto. The exhaust tube 25 extends through the top wall portion 22*c* of the outer container 22 and the second heat insulating portion 23*c* of the heat insulating material 23.

The side wall portion 22*d* of the outer container 22 is provided at a lower end thereof with a liquid discharge outlet 22*b*. A liquid discharge tube 26 is inserted into the liquid discharge outlet 22*b* so as to be joined thereto. The liquid discharge tube 26 is provided for discharging a liquid collected in the bottom of the outer container 22 (including liquid having splashed out of the liquid container 21 and liquid contained in LNG or the like which has a high boiling point and hence is hard to vaporize) from the outer container 22. Specifically, the liquid discharge tube 26 extends through the side wall portion 22*d* of the outer container 22 and the side portion of the first heat insulating portion 23*b* of the heat insulating material 23. The liquid discharged from the liquid discharge tube 26 is separately vaporized by a non-illustrated vaporizer and then recovered. The liquid discharge tube 26 is provided with a valve 26*a* for regulating the discharging amount of the liquid.

Use of a sprayed fluid (i.e., a fluid in a state in which a liquid is dispersed like mist in a gas) as the liquid is possible. In this case, the liquid discharge outlet 22*b* and the liquid discharge tube 26 can be omitted.

The bottom wall portion 22*f* of the outer container 22 is formed with an opening 22*g*. The first heat insulating portion 23*b* of the heat insulating material 23 is formed with an opening 23*d*. The cylinder 16 of the Stirling engine 10 is fitted in these openings 22*g* and 23*d*.

The guide portion 24 is located in the space portion 30 and configured to guide the gas vaporized in the liquid container 21 to the exhaust vent 22*a* by causing the gas to ascend along the inner wall surface 22*e* of the side wall portion 22*d* of the outer container 22. The guide portion 24 includes a first guide wall 24*a*, a second guide wall 24*b*, and a fitting portion 24*c*.

The first guide wall 24*a* is located between the opening 21*a* of the liquid container 21 and the exhaust vent 22*a* of the outer container 22. The first guide wall 24*a* serves to guide the gas laterally by inhibiting the gas from ascending from the liquid container 21 toward the exhaust vent 22*a*.

The second guide wall 24*b* extends downwardly from the peripheral edge of the first guide wall 24*a* and intervenes between the liquid container 21 and the side wall portion 22*d* of the outer container 22. The second guide wall 24*b* forms a downflow path 24*e* between the second guide wall 24*b* and the liquid container 21 for causing the gas to descend along an outer surface 21*b* of the liquid container 21 and an upflow path 24*d* between the second guide wall 24*b* and the outer container 22 for causing the gas to ascend along the inner wall surface 22*e* of the side wall portion 22*d* of the outer container 22.

A clearance which provides communication between the downflow path 24*e* and the upflow path 24*d* is provided between the second guide wall 24*b* and an upper surface of the bottom wall portion 22*f* of the outer container 22.

The second guide wall 24*b* actively forms a downflow of the gas along the outer surface 21*b* of the liquid container 21 and an upflow of the gas along the side wall portion 22*d* of the outer container 22 in the space portion 30.

The fitting portion 24*c* interconnects the first guide wall 24*a* and the top wall portion 22*c* of the outer container 22. The fitting portion 24*c* is provided with a non-illustrated breathing portion for allowing the gas to pass therethrough.

The liquid supply device 60 is connected to one end of a supply pipe 41. The other end of the supply pipe 41 is located in the liquid container 21 to supply the liquid to the liquid container 21 through the pipe 41. The supply pipe 41 is provided with a valve 41*a* for regulating the supply amount of the liquid.

The air-heated vaporizer 50 is fitted on the exhaust tube 25. The air-heated vaporizer 50 is provided for warming the gas passing through the exhaust tube 25 to a predetermined temperature.

In the vaporization device 20 thus constructed, the liquid supplied from the liquid supply device 60 to the liquid container 21 through the supply pipe 41 is vaporized in the liquid container 21 by supplying the cold heat thereof to the upper portion 16*a* of the cylinder 16. The gas thus vaporized in the liquid container 21 is exhausted from the exhaust vent 22*a* via the space portion 30. Specifically, the gas vaporized in the liquid container 21 is guided laterally by the first guide wall 24*a*, descends through the downflow path 24*e* between the liquid container 21 and the second guide wall 24*b*, passes under the lower end of the second guide wall 24*b*, ascends through the upflow path 24*d* between the second guide wall 24*b* and the side wall portion 22*d* of the outer container 22, and finally reaches the exhaust vent 22*a*, as indicated by arrows in FIG. 1. Thereafter, the gas is exhausted through the exhaust tube 25 while being warmed to the predetermined temperature.

Therefore, the low-temperature gas vaporized in the liquid container 21 absorbs amounts of infiltration heat from the outer wall surface 23*a* of the heat insulating material 23 one after another while passing between the liquid container 21 and the outer wall surface 23*a* of the heat insulating material 23 during the passage thereof up to the exhaust vent 22*a* through the space portion 30. That is, by effectively utilizing the gas vaporized in the liquid container 21 and flowing out of the liquid container 21 as a heat absorbing medium, consumption of the cold heat of the liquid in the liquid container 21 by the infiltration heat is suppressed continuously and, hence, the heat insulating property for the liquid container 21 is maintained. By virtue of this, the amount of cold heat of the liquid to be supplied to the upper portion 16*a* of the cylinder 16 is stabilized, which leads to stabilization of the operating efficiency of the Stirling engine 10 and stabilization of the power recovery rate.

The foregoing embodiment is configured to provide heat insulation for the liquid container 21 by causing the gas vaporized in the liquid container 21 to pass through the space portion 30. For this reason, the embodiment does not need to separately provide a low-temperature gas to pass through the space portion 30 and hence is cost effective.

The temperature of the gas vaporized by losing its cold heat (latent heat) is substantially equal to that of the liquid before vaporization. Therefore, even when such a low-temperature gas is fed into the space portion 30, the cold heat of the liquid in the liquid container 21 can hardly be consumed by the gas present in the space portion 30 and, hence, the heat insulating property is not impaired thereby.

In the foregoing embodiment, the inner wall surface 22*e* of the outer container 22 is spaced apart from the liquid container 21 to define the space portion 30 between the outer container 22 and the liquid container 21, while the outer container 22 is provided with the exhaust vent 22*a*. This arrangement allows the gas vaporized in the liquid container 21 to flow into the space portion 30 surrounding the liquid container 21 spontaneously, thus facilitating the feeding of the gas into the space portion 30. Further, the space portion 30 can be easily formed by merely devising ways of positioning the inner wall surface 22*e* of the outer container 22.

The provision of the exhaust vent 22*a* at the top wall portion 22*c* of the outer container 22 enables the gas heated by absorbing the infiltration heat to be exhausted from the space portion 30 quickly. Therefore, a rise in the temperature of the space portion 30 can be suppressed.

In the foregoing embodiment, the space portion 30 is provided with the guide portion 24 for guiding the gas vaporized in the liquid container 21 to the exhaust vent 22*a* by causing the gas to ascend along the inner wall surface 22*e* of the side wall portion 22*d* of the outer container 22. This arrangement actively forms in the space portion 30 an upflow of the gas along the side wall portion 22*d* of the outer container 22, thus allowing the gas flowing in the space portion 30 to absorb the infiltration heat efficiently.

The provision of the first guide wall 24*a* makes it possible to suppress the exhaust of the vaporized gas from the exhaust vent 22*a* without absorption of the infiltration heat. For this reason, the infiltration heat can be absorbed by the gas more efficiently.

In the foregoing embodiment, the downflow path 24*e* and the upflow path 24*d* are formed by the provision of the second guide wall 24*b*. This causes a downflow of the gas along the outer surface 21*b* of the liquid container 21 and an upflow of the gas along the inner wall surface 22*e* of the side wall portion 22*d* of the outer container 22 to be actively formed in the space portion 30. Therefore, the gas flowing in the space portion 30 absorbs the infiltration heat further efficiently.

In the foregoing embodiment, the liquid supply device 60 is provided for supplying the liquid to the liquid container 21 continuously. This arrangement can function as a continuous vaporization system for converting liquid to gas continuously.

Figure 2:
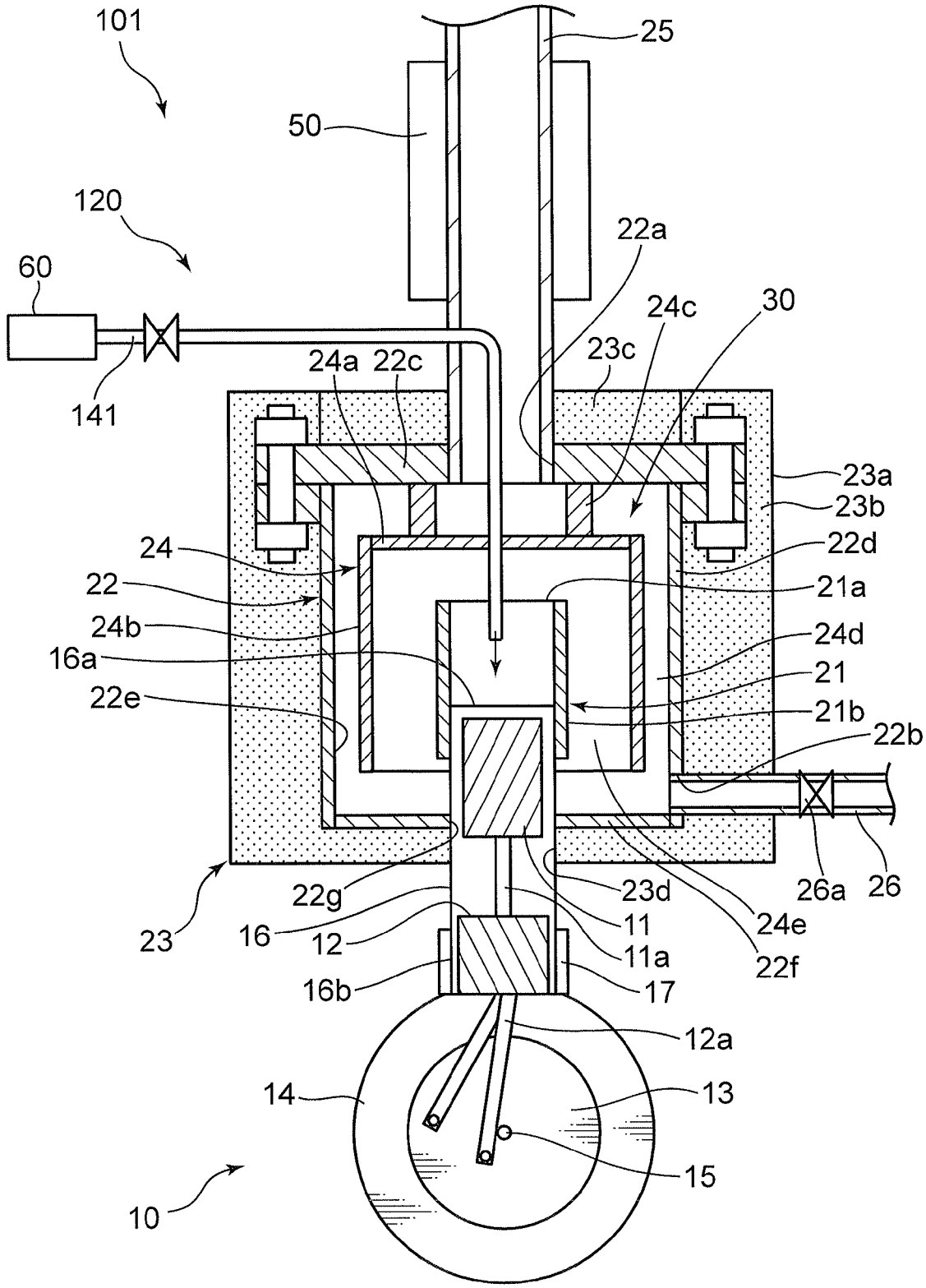
FIG. 2 is a sectional view illustrating a power recovery system according to Variation 1 of the first embodiment.

FIG. 2 illustrates Variation 1 of the foregoing first embodiment. A power recovery system 101 illustrated in FIG. 2 includes a vaporization device 120 which is different from that of the foregoing embodiment in the liquid supply line to the liquid container 21. The vaporization device 120 has a supply pipe 141 which extends through the wall of the exhaust tube 25 and the first guide wall 24*a* to reach the liquid container 21 unlike the foregoing embodiment. With such an arrangement, there is no need to provide the outer container 22 and the heat insulating material 23 with respective holes for inserting the supply pipe therethrough. Therefore, degradation in heating insulating property due to the formation of the holes in the outer container 22 and heat insulating material 23 can be suppressed.

Figure 3:
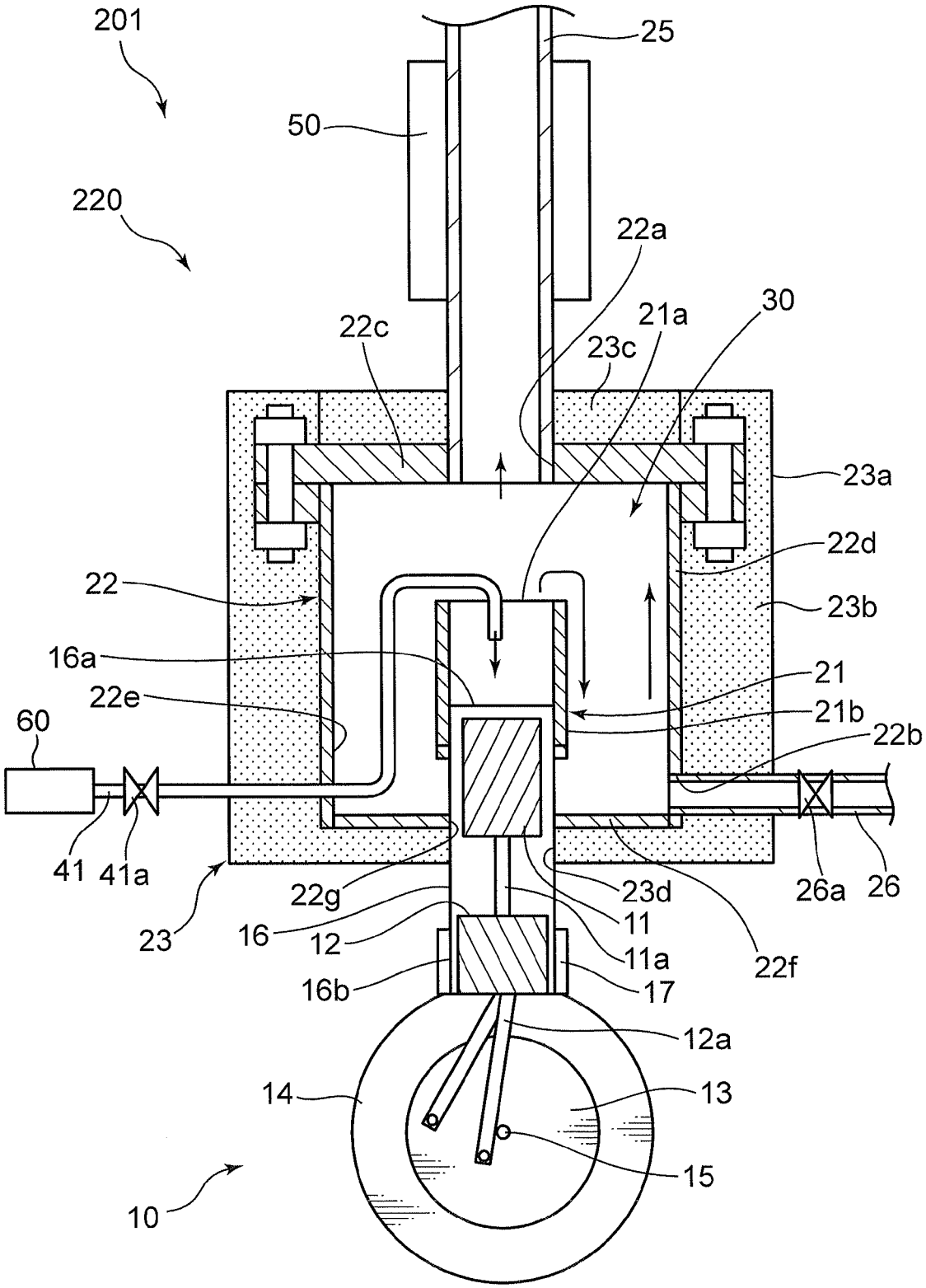
FIG. 3 is a sectional view illustrating a power recovery system according to Variation 2 of the first embodiment.

FIG. 3 illustrates Variation 2 of the first embodiment. A power recovery system 220 illustrated in FIG. 3 includes a vaporization device 220 from which the guide portion 24 according to the foregoing embodiment is omitted. Even in the vaporization device 220, the gas vaporized in the liquid container 21 flows into the space portion 30, passes between the liquid container 21 and the outer wall surface 23*a* of the heat insulating material 23, and is then exhausted from the exhaust vent 22*a*. The temperature of the gas having flowed into the space portion 30 rises by absorption of the infiltration heat from the outer wall surface 23*a* of the heat insulating material 23 and, hence, the gas ascends along the inner wall surface 22*e* of the side wall portion 22*d* of the outer container 22. For this reason, in the space portion 30 a downflow of low-temperature gas along the outer surface 21*b* of the liquid container 21 and an upflow of high-temperature gas along the side wall portion 22*d* of the outer container 22 are formed spontaneously. Even when the vaporization device 220 is thus simplified in structure by eliminating the guide portion 24, the heat insulating property for the liquid container 21 can be maintained to a certain extent.

Instead of emitting the entire guide portion 24 as in Variation 2, only the second guide wall 24*b* of the guide portion 24 may be emitted. In this case, the first guide wall 24*a* actively guides the gas laterally by inhibiting the gas vaporized in the liquid container 21 from ascending, so that flows of the gas are formed more actively in the space portion 30. This arrangement can maintain the heat insulating property more effectively than Variation 2.

However, the provision of the second guide wall 24*b* as in the vaporization device 20 of the first embodiment makes it possible to prevent the gas from circulating within the space portion 30. For this reason, the provision of the second guide wall 24*b* is more preferable.

Second Embodiment

Figure 4:
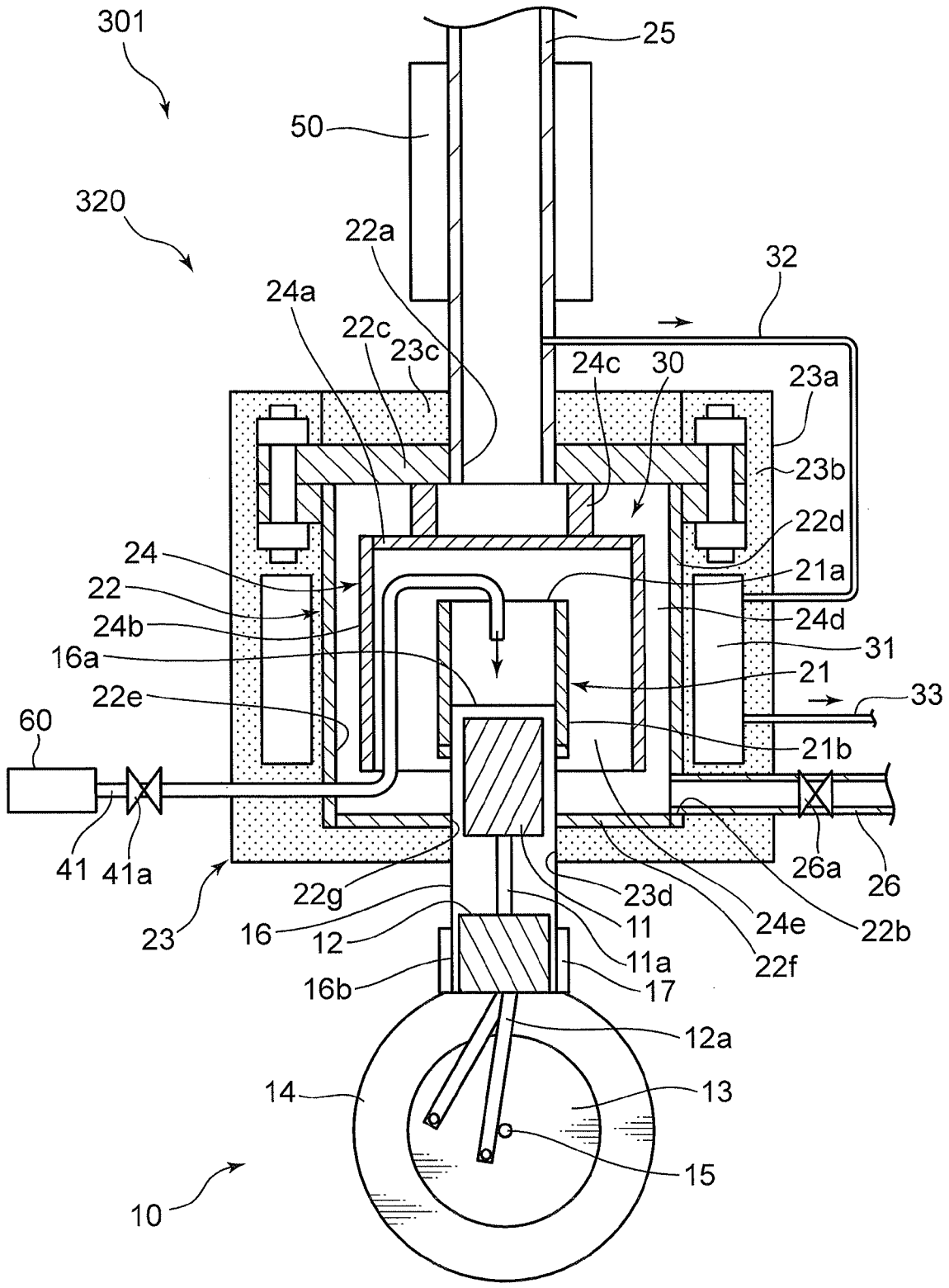
FIG. 4 is a sectional view illustrating a power recovery system according to a second embodiment of the present invention.

FIG. 4 illustrates a power recovery system 301 according to a second embodiment. As shown in FIG. 4, the power recovery system 301 includes a vaporization device 320 which is provided with a space portion 31 inside the heat insulating material 23 (first heat insulating portion 23*b*) in addition to the space portion 30 of the foregoing first embodiment. The space portion 31 is corresponding to the "second space portion (part of the peripheral space)" defined by the present invention. The space portion 31 is defined between the outer container 22 and the outer wall surface 23*a* of the heat insulating material 23 so as to surround the outer container 22. The space portion 31 is in communication with the exhaust tube 25 through a guide pipe 32 extending through the heat insulating material 23. Further, the space portion 31 is connected to an exhaust pipe 33 for exhausting the gas present in the space portion 31. The exhaust pipe 33 extends through the first heat insulating portion 23*b* of the heat insulating material 23.

The power recovery system 301 according to the second embodiment is provided with the space portion 31 in addition to the space portion 30. This arrangement allows the gas vaporized in the liquid container 21 to pass between the liquid container 21 and the outer wall surface 23*a* of the heat insulating material 23 through the space portion 30 during passage thereof up to the exhaust vent 22*a* while enabling part of the gas having been exhausted from the exhaust vent 22*a* to pass between the liquid container 21 and the outer wall surface 23*a* of the heat insulating material 23 via the guide pipe 32 and the space portion 31. For this reason, the gas in the two space portions 30 and 31 absorbs infiltration heat from the outer wall surface 23*a* of the heat insulating material 23 one after another before the infiltration heat reaches the liquid container 21. Therefore, consumption of the cold heat of the liquid in the liquid container 21 by the infiltration heat can be further suppressed.

A power recovery system to be described below may be constructed as a variation of the second embodiment. Specifically, in the power recovery system according to this variation, the exhaust vent 22*a* of the outer container 22 is closed, while the outer container 22 and the space portion 31 are in communication with each other. Further, the space portion 31 is connected to a non-illustrated exhaust portion through the exhaust pipe 33.

In this variation, it is possible that the liquid is stored directly in the outer container 22 by emitting the liquid container 21. In this case, the power recovery system of the variation includes only of the space portion 31 with the space portion 30 eliminated. In this arrangement, the outer container 22 is corresponding to the "liquid storage portion"

defined by the present invention and the heat insulating material 23 is solely corresponding to the "outer member" defined by the present invention.

The Stirling engine used in the foregoing embodiments and the variations thereof is only an example and is not limited to its construction illustrated. Therefore, the present invention is applicable to a power recovery system in which another Stirling engine which operates based on a different mechanism than the above-described engine is combined with the vaporization device.

In the foregoing embodiments and the variations thereof, the liquid is supplied to the liquid container 21 in such a manner as to be poured thereinto from above. However, there is no limitation to this arrangement. For example, an arrangement may be adopted in which the supply pipe is disposed so as to extend through a side wall portion of the liquid container 21 for the liquid to be supplied into the liquid container 21 through the supply pipe.

The foregoing specific embodiments each include mainly an invention having the following construction.

In order to accomplish the foregoing object, the present invention provides a power recovery system including: a Stirling engine having a hot heat exchanging portion and a cold heat exchanging portion and generating power by supply of hot heat to the hot heat exchanging portion and supply of cold heat to the cold heat exchanging portion; and a vaporization device including a liquid storage portion which stores therein a liquid having cold heat in such a manner that the liquid is kept in contact with the cold heat exchanging portion, an outer member which embraces the liquid storage portion and defines a peripheral space portion around the liquid storage portion, and an exhaust portion which is located at a position away from the liquid storage portion and exhausts gas vaporized in the liquid storage portion from the outer member, the vaporization device being configured to vaporize the liquid by supplying the cold heat of the liquid to the cold heat exchanging portion, wherein the peripheral space portion communicates with the liquid storage portion and the exhaust portion to allow the gas vaporized in the liquid storage portion to pass between the liquid storage portion and an outer wall surface of the outer member during passage thereof from the liquid storage portion to the exhaust portion.

In the power recovery system according to the present invention, the low-temperature gas vaporized in the liquid storage portion passes between the liquid storage portion and the outer wall surface of the outer member during the passage thereof up to the exhaust portion through the peripheral space portion. For this reason, amounts of infiltration heat from the outer wall surface of the outer member are absorbed one after another by the gas flowing in the peripheral space portion before reaching the liquid storage portion. Therefore, consumption of the cold heat of the liquid in the liquid storage portion by the infiltration heat is suppressed continuously and, hence, the heat insulating property for the liquid storage portion is maintained. By virtue of this, the amount of cold heat of the liquid to be supplied to the cold heat exchanging portion is stabilized, which leads to stabilization of the operating efficiency of the Stirling engine and stabilization of the power recovery rate.

In the present invention, heat insulation for the liquid storage portion is provided by allowing the gas vaporized in the liquid storage portion to pass through the peripheral space portion. For this reason, the present invention does not need to separately provide a low-temperature gas to pass through the peripheral space portion and hence is cost effective.

The temperature of the gas vaporized by losing its cold heat (latent heat) is substantially equal to that of the liquid before vaporization. Therefore, even when such a low-temperature gas is fed into the peripheral space portion, the cold heat of the liquid in the liquid storage portion can hardly be consumed by the gas present in the peripheral space portion. For this reason, the heat insulating property for the liquid storage portion is not impaired.

In the power recovery system described above, it is preferable that: the outer member has an inner wall surface which is spaced apart from the liquid storage portion to define a first space portion constructing at least part of the peripheral space portion between the liquid storage portion and the inner wall surface; and the exhaust portion includes an exhaust vent provided at the outer member.

In this aspect, the gas vaporized in the liquid storage portion is allowed to flow into the first space portion surrounding the liquid storage portion spontaneously. Thus, the feeding of the gas into the first space portion is facilitated. Further, the first space portion can be easily formed by merely devising ways of positioning the inner wall surface of the outer member.

In the above-described power recovery system, the exhaust vent is preferably located at a top wall portion of the outer member to allow the gas having ascended due to a temperature rise thereof to be exhausted through the exhaust vent.

In this aspect, the gas of which the temperature has risen by absorption of the infiltration heat is exhausted from the first space portion quickly. Therefore, a rise in the temperature of the first space portion is suppressed.

In the above-described power recovery system, the vaporization device preferably includes a guide portion which is located in the first space portion and configured to guide the gas vaporized in the liquid storage portion to the exhaust vent by causing the gas to ascend along an inner wall surface of a side wall portion of the outer member.

In this aspect, the guide portion actively forms an upflow of the gas along the side wall portion of the outer member in the first space portion. For this reason, the infiltration heat is efficiently absorbed by the gas flowing in the first space portion.

In the above-described power recovery system, the guide portion preferably includes a first guide wall which is located between the liquid storage portion and the exhaust vent and which guides the gas laterally by inhibiting the gas from ascending from the liquid storage portion toward the exhaust vent.

In this aspect, the provision of the first guide wall makes it possible to suppress the exhaust of the vaporized gas from the exhaust vent without absorption of the infiltration heat. For this reason, the infiltration heat is absorbed by the gas more efficiently.

In the above-described power recovery system, the guide portion preferably further includes a second guide wall which extends downwardly from a peripheral edge of the first guide wall to form a downflow path between the liquid storage portion and the second guide wall for causing the gas to descend along an outer surface of the liquid storage portion and an upflow path between the outer member and the second guide wall for causing the gas to ascend along the inner wall surface of the side wall portion of the outer member.

In this aspect, the second guide wall actively forms a downflow of the gas along the outer surface of the liquid storage portion and an upflow of the gas along the side wall portion of the outer member in the first space portion. Therefore, the infiltration heat is absorbed by the gas flowing in the first space portion further efficiently.

In the above-described power recovery system, it is preferable that the outer member is internally provided with a second space portion which communicates with the liquid storage portion and the exhaust portion while constructing at least part of the peripheral space portion.

In this aspect, the gas vaporized in the liquid storage portion is allowed to pass between the liquid storage portion and the outer wall surface of the outer member during passage thereof from the liquid storage portion to the exhaust portion through the second space portion formed inside the outer member. Thus, amounts of infiltration heat from the outer wall surface of the outer member are absorbed one after another by the gas flowing in the second space portion before reaching the liquid storage portion. Therefore, consumption of the cold heat of the liquid in the liquid storage portion by the infiltration heat is suppressed continuously.

In the above-described power recovery system, the vaporization device preferably further includes a liquid supply device which is connected to the liquid storage portion and supplies the liquid to the liquid storage portion continuously.

In this aspect, the vaporization device includes the liquid supply device. This arrangement can provide a continuous vaporization system which converts liquid to gas continuously. The system thus makes it possible to maintain the power recovery rate.

INDUSTRIAL APPLICABILITY

In the power recovery system according to the present invention, the low-temperature gas vaporized in the liquid storage portion passes between the liquid storage portion and the outer wall surface of the outer member during passage thereof up to the exhaust portion through the space portion. For this reason, amounts of infiltration heat from the outer wall surface of the outer member are absorbed one after another by the gas flowing in the space portion before reaching the liquid storage portion. Therefore, consumption of the cold heat of the liquid in the liquid storage portion by the infiltration heat is suppressed continuously and, hence, the heat insulating property for the liquid storage portion is maintained. By virtue of this, the amount of cold heat of the liquid to be supplied to the cold heat exchanging portion is stabilized, which leads to stabilization of the operating efficiency of the Stirling engine and stabilization of the power recovery rate.

EXPLANATION OF REFERENCE NUMERALS

1, 101, 220, 301 power recovery system
10 Stirling engine
16*a* upper portion of cylinder (cold heat exchanging portion)
16*b* lower portion of cylinder (hot heat exchanging portion)
20, 120, 220, 320 vaporization device
21 liquid container (liquid storage portion)
21*a* opening
22 outer container (exemplary outer member)
22*a* exhaust vent (exhaust portion)
23 heat insulating material (exemplary outer member)
23*a* outer wall surface
24 guide portion
24*a* first guide wall
24*b* second guide wall
24*d* upflow path
24*e* downflow path
30 space portion (first space portion: peripheral space portion)
31 space portion (second space portion: part of peripheral space portion)
60 liquid supply device

The invention claimed is:

1. A power recovery system comprising:

a Stirling engine having a hot heat exchanging portion and a cold heat exchanging portion and generating power by supply of hot heat to the hot heat exchanging portion and supply of cold heat to the cold heat exchanging portion; and a vaporization device including a liquid storage portion which stores therein a liquid having cold heat in such a manner that the liquid is kept in contact with the cold heat exchanging portion, an outer member which embraces the liquid storage portion and defines a peripheral space portion around the liquid storage portion, and an exhaust portion which is located at a position away from the liquid storage portion and exhausts gas vaporized in the liquid storage portion from the outer member, the vaporization device being configured to vaporize the liquid by supplying the cold heat of the liquid to the cold heat exchanging portion, wherein the peripheral space portion communicates with the liquid storage portion and the exhaust portion to allow the gas vaporized in the liquid storage portion to pass between the liquid storage portion and an outer wall surface of the outer member during passage thereof from the liquid storage portion to the exhaust portion, and the peripheral space portion includes a region formed between an inner surface of the liquid storage portion and the outer wall surface of the outer member, and between a top level of the liquid stored in the liquid storage portion and a bottom level of the liquid stored in the liquid storage portion.

2. The power recovery system according to claim 1, wherein the outer member has an inner wall surface which is spaced apart from the liquid storage portion to define a first space portion constructing at least part of the peripheral space portion between the liquid storage portion and the inner wall surface; and wherein the exhaust portion includes an exhaust vent provided at the outer member.

3. The power recovery system according to claim 2, wherein the exhaust vent is located at a top wall portion of the outer member to allow the gas having ascended due to a temperature rise thereof to be exhausted through the exhaust vent.

4. A power recovery system comprising:

a Stirling engine having a hot heat exchanging portion and a cold heat exchanging portion and generating power by supply of hot heat to the hot heat exchanging portion and supply of cold heat to the cold heat exchanging portion; and a vaporization device including a liquid storage portion which stores therein a liquid having cold heat in such a manner that the liquid is kept in contact with the cold heat exchanging portion, an outer member which embraces the liquid storage portion and defines a peripheral space portion around the liquid storage portion, and an exhaust portion which is located at a position away from the liquid storage portion and exhausts gas vaporized in the liquid storage portion from the outer member, the vaporization device being configured to vaporize the liquid by supplying the cold heat of the liquid to the cold heat exchanging portion, wherein the peripheral space portion communicates with the liquid storage portion and the exhaust portion to allow the gas vaporized in the liquid storage portion to pass between the liquid storage portion and an outer wall surface of the outer member during passage thereof from the liquid storage portion to the exhaust portion, the outer member has an inner wall surface which is spaced apart from the liquid storage portion to define a first space portion constructing at least part of the peripheral space portion between the liquid storage portion and the inner wall surface, the exhaust portion includes an exhaust vent provided at the outer member, the exhaust vent is located at a top wall portion of the outer member to allow the gas having ascended due to a temperature rise thereof to be exhausted through the exhaust vent, and the vaporization device includes a guide portion which is located in the first space portion and configured to guide the gas vaporized in the liquid storage portion to the exhaust vent by causing the gas to ascend along an inner wall surface of a side wall portion of the outer member.

5. The power recovery system according to claim 4, wherein the guide portion includes a first guide wall which is located between the liquid storage portion and the exhaust vent and which guides the gas laterally by inhibiting the gas from ascending from the liquid storage portion toward the exhaust vent.

6. The power recovery system according to claim 5, wherein the guide portion further includes a second guide wall which extends downwardly from a peripheral edge of the first guide wall to form a downflow path between the liquid storage portion and the second guide wall for causing the gas to descend along an outer surface of the liquid storage portion and an upflow path between the outer member and the second guide wall for causing the gas to ascend along the inner wall surface of the side wall portion of the outer member.

7. The power recovery system according to claim 1, wherein the outer member is internally provided with a second space portion which communicates with the liquid storage portion and the exhaust portion while constructing at least part of the peripheral space portion.

8. The power recovery system according to claim 1, wherein the vaporization device further includes a liquid supply device which is connected to the liquid storage portion and supplies the liquid to the liquid storage portion continuously.

* * * * *